US010807141B2

(12) United States Patent
Sines et al.

(10) Patent No.: US 10,807,141 B2
(45) Date of Patent: Oct. 20, 2020

(54) REDRAW SLEEVE

(71) Applicant: Stolle Machinery Company, LLC, Centennial, CO (US)

(72) Inventors: James Alan Sines, Broomfield, CO (US); Christopher Michael Harmon, Lone Tree, CO (US)

(73) Assignee: Stolle Machinery Company, LLC, Centennial, CO (US)

( * ) Notice: Subject to any disclaimer, the term of this patent is extended or adjusted under 35 U.S.C. 154(b) by 430 days.

(21) Appl. No.: 15/399,795

(22) Filed: Jan. 6, 2017

(65) Prior Publication Data

US 2018/0193894 A1 Jul. 12, 2018

(51) Int. Cl.
*B21D 22/30* (2006.01)
*B21D 22/28* (2006.01)

(52) U.S. Cl.
CPC ..... *B21D 22/30* (2013.01); *B21D 22/28* (2013.01)

(58) Field of Classification Search
CPC ..... B21D 22/30; B21D 22/28
See application file for complete search history.

(56) References Cited

U.S. PATENT DOCUMENTS

| | | | |
|---|---|---|---|
| 5,105,645 | A | 4/1992 | Kobayashi et al. |
| 5,343,729 | A | 9/1994 | Saunders |
| 5,394,727 | A | 3/1995 | Diekhoff et al. |
| 5,454,252 | A | 10/1995 | Mueller |
| 5,497,646 | A | 3/1996 | Roberts et al. |
| 5,775,160 | A | 7/1998 | Fleischer et al. |
| 5,946,964 | A | 9/1999 | Snyder et al. |
| 9,352,375 | B2 | 5/2016 | Haulsee |
| 2015/0068268 | A1 | 3/2015 | Haulsee |

OTHER PUBLICATIONS

Stolle Machinery Company, LLC, PCT/US2018/012029 International Search Report and Written Opinion, dated Mar. 5, 2018, 15 pages.
Stolle Machinery Company, LLC, U.S. Appl. No. 15/286,954, filed Oct. 6, 2016; Container, and Selectively Formed Cup, Tooling and Associated Method for Providing Same, 103 pages.
Stolle Machinery Company, LLC, EP Application 18736092.0 European Search Report, dated Jul. 10, 2020, 7 pages.

*Primary Examiner* — Teresa M Ekiert
(74) *Attorney, Agent, or Firm* — Eckert Seamans Cherin & Mellott, LLC

(57) ABSTRACT

A redraw sleeve is provided. The redraw sleeve includes a body with a second end, wherein the second end includes a shaped contour. The shaped contour, as defined herein, substantially prevents wrinkles and/or tears, as well as other forming problems, when forming thin metal.

8 Claims, 3 Drawing Sheets

REDRAW SLEEVE

BACKGROUND OF THE INVENTION

Field of the Invention

The disclosed concept relates generally to a can bodymaker and, more specifically, to a can bodymaker having a redraw assembly including a redraw sleeve with a shaped contour.

Background Information

Generally, a can begins as a disk of metal, such as, but not limited to aluminum, also known as a "blank," that is punched from a sheet or coil of metal. The blank is fed into a cupper. The cupper performs a blank and draw process to create a cup. That is, the blank is formed into a cup having a bottom and a depending sidewall. The cup is fed into one of several bodymakers, which perform a redraw and ironing operation. More specifically, the cup is disposed in a can forming machine at the mouth of a die pack having substantially circular openings therein. The cup is held in place by a redraw sleeve, which is part of the redraw assembly. The redraw sleeve is a hollow tubular construct that is disposed inside the cup and biases the cup against the die pack. The axial surface of the redraw sleeve extends substantially perpendicular to the longitudinal axis of the ram, discussed below. The radial surface of the redraw sleeve extends substantially parallel to the longitudinal axis of the ram and is generally smooth, i.e., the radial surface does not include offset portions. The first die in the die pack is the redraw die, which is also a part of the redraw assembly. The cup is biased against the redraw die by the redraw sleeve. Other dies, the ironing dies, are disposed behind, and axially aligned with, the redraw die. The ironing dies are not pan of the redraw assembly. An elongated, cylindrical ram having a punch at the forward, distal end is aligned with, and structured to travel through, the openings in the redraw die and the ironing dies. At the end of the die pack opposite the ram is a dourer. The darner is a die structured to form a concave dome in the bottom of the cup/can.

It is desirable to use as little material as possible to form the can. Generally, to reduce the amount of material used to form the can, the thickness of the sheet material is reduced. Thin metal, however, tends to wrinkle and/or tear when acted upon by a redraw sleeve having an axial surface that extends substantially perpendicular to the longitudinal axis of the ram, discussed below, and a radial surface that extends substantially parallel to the longitudinal axis of the ram and without offsets. Further, a redraw sleeve wherein the transition portion between the redraw sleeve axial surface and the redraw sleeve radial surface is not tangent and congruent to the contour of the cup tends to wrinkle and/or tear thin metal. Thus, the shape/contour of a redraw sleeve, especially the end of the redraw sleeve that engages the cup, is a stated problem.

SUMMARY OF THE INVENTION

The disclosed and claimed concept provides a redraw sleeve including a body with a second end, wherein the second end includes a shaped contour. The shaped contour, as defined below, substantially prevents wrinkles and/or tears, as well as other forming problems, when forming thin metal. Thus, the redraw sleeve shaped contour solves the problems stated above.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
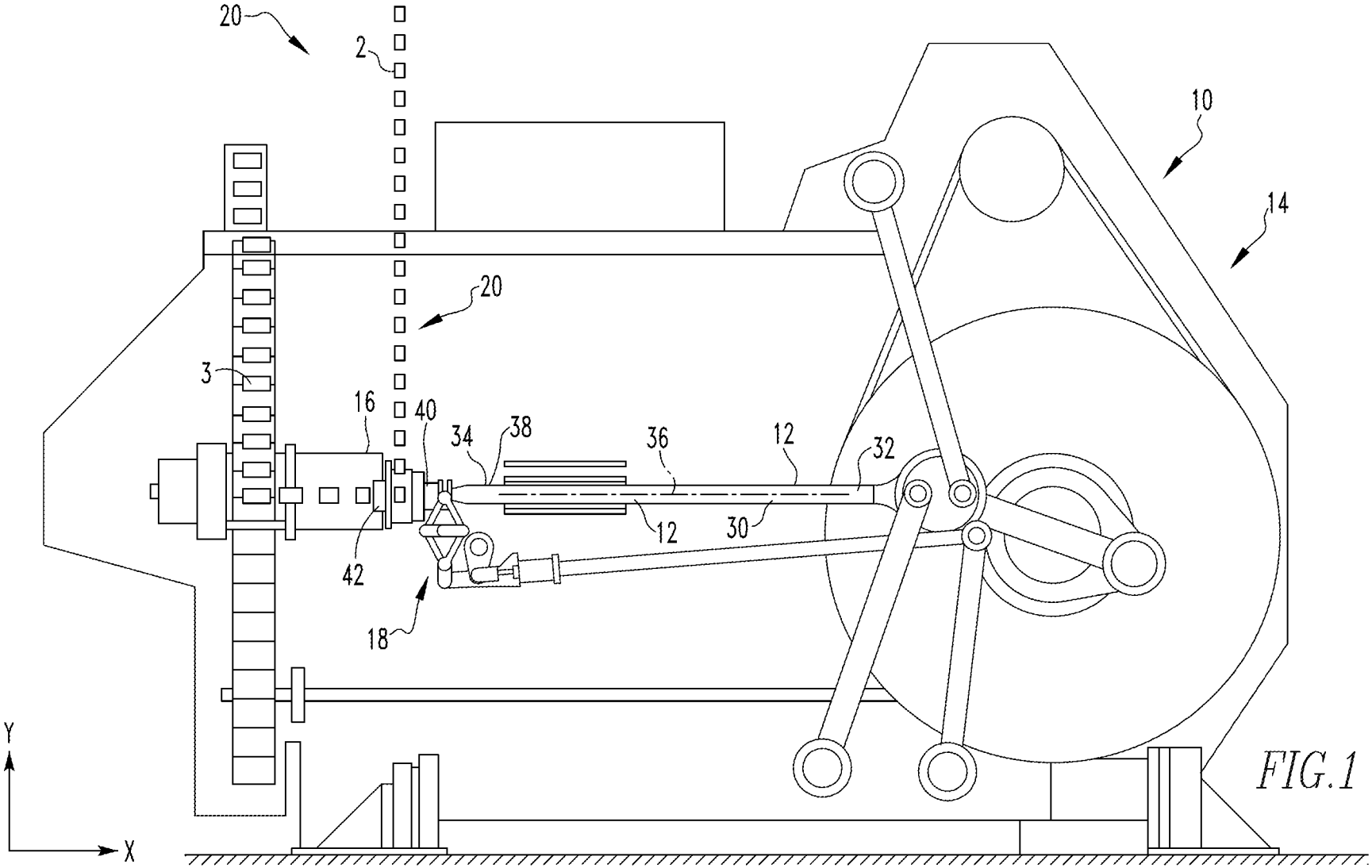
FIG. 1 is a side, partially schematic view of a bodymaker.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element (s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours.

As used herein, a "planar body" or "planar member" is a generally thin element including opposed, wide, generally parallel surfaces, i.e., the planar surfaces of the planar member, as well as a thinner edge surface extending between the wide parallel surfaces.

That is, as used herein, it is inherent that a "planar" element has two opposed planar surfaces. The perimeter, and therefore the edge surface, may include generally straight portions, e.g., as on a rectangular planar member, or be curved, as on a disk, or have any other shape.

As used herein, a "path of travel" or "path," when used in association with an element that moves, includes the space an element moves through when in motion. As such, any element that moves inherently has a "path of travel" or "path."

As used herein, the statement that two or more parts or components "engage" one another shall mean that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A either engages element B while in element A first position.

As used herein, "operatively engage" means "engage and move." That is, "operatively engage" when used in relation to a first component that is structured to move a movable or rotatable second component means that the first component applies a force sufficient to cause the second component to move. For example, a screwdriver may be placed into contact with a screw. When no force is applied to the screwdriver, the screwdriver is merely "coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with electronic components, "operatively engage" means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality).

As used herein, in the phrase "[x] moves between its first position and second position," or, "[y] is structured to move [x] between its first position and second position," "[x]" is the name of an element or assembly. Further, when [x] is an element or assembly that moves between a number of positions, the pronoun "its" means "[x]," i.e., the named element or assembly that precedes the pronoun "its."

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can.

As employed herein, the terms "can" and "container" are used substantially interchangeably to refer to any known or suitable container, which is structured to contain a substance (e.g., without limitation, liquid; food; any other suitable substance), and expressly includes, but is not limited to, beverage cans, such as beer and soda cans, as well as food cans.

As used herein, "generally curvilinear" includes elements having multiple curved portions, combinations of curved portions and planar portions, and a plurality of planar portions or segments disposed at angles relative to each other thereby forming a curve.

As used herein, a "contour" means the line or surface, that defines an object. That is, for example, when viewed in cross-section, the surface of a three-dimensional object is reduced to two dimensions; thus, a portion of a three-dimensional surface contour is represented by a two-dimensional line contour.

As used herein, a "perimeter portion" means the area at the outer edge of a defined area, surface, or contour.

As used herein, "generally" means "in a general manner" relevant to the term being modified as would be understood by one of ordinary skill in the art.

As used herein, "substantially" means "for the most part" relevant to the term being modified as would be understood by one of ordinary skill in the art.

As used herein, "at" means on and near relevant to the term being modified as would be understood by one of ordinary skill in the art.

As shown in FIG. 1, a can bodymaker 10 is structured to convert a cup 2 into a can body 3. As described below, the cup 2 is assumed to be substantially circular. It is understood, however, that the cup 2, as well as the resulting can body 3 and elements that interact with the cup 2 or can body 3, may have a shape other than substantially circular. A cup 2 has a bottom member with a depending sidewall defining a substantially enclosed space (none shown). The end of the cup 2 opposite the bottom is open. The can bodymaker 10 includes a reciprocating ram 12, a drive mechanism 14, a die pack 16, a redraw assembly 18 and a cup feeder 20 (shown schematically). That is, the drive mechanism 14 is coupled to the ram 12 and structured to impart a reciprocating motion to the ram 12. As is known, in each cycle the cup feeder 20 positions a cup 2 in front of the die pack 16 with the open end facing the ram 12. When the cup 2 is in position in front of the die pack 16, a redraw sleeve assembly 40, described below, biases the cup 2 against a redraw die 42, described below. The ram 12 has an elongated, substantially circular body 30 with a proximal end 32, a distal end 34, and a longitudinal axis 36. The ram body distal end 34 includes a punch 38. The ram body proximal end 32 is coupled to the drive mechanism 14. The drive mechanism 14 provides a reciprocal motion to the ram body 30 causing the ram body 30 to move back and forth along its longitudinal axis 36. That is, the ram body 30 is structured to reciprocate between a first, retracted position and a second, extended position. In the first, retracted position, the ram body 30 is spaced from the die pack 16. In the second, extended position, the ram body 30 extends through the die pack 16. Thus, the reciprocating ram 12 advances forward (to the left as shown) passing through the redraw sleeve assembly 40, discussed below, and engaging the cup 2. The cup 2 is moved through the redraw die 42 and a number of ironing dies (not shown) within the die pack 16. The cup 2 is converted into a can body 3 within the die pack 16 and then removed therefrom. It is understood that, as used herein, a "cycle" means the cycle of the ram 12 which begins with the ram 12 in the first, retracted position.

Generally, the redraw assembly 18 includes a movable redraw sleeve assembly 40 and a redraw die 42. The redraw die 42 is disposed within the die pack 16 adjacent the redraw sleeve assembly 40. That is, the redraw die 42 is the first die in the die pack 16.

The redraw die 42 has a circular opening 44 with a central axis 46 which also extends through the die pack 16. That is, the redraw die central, or longitudinal, axis 46 is also the longitudinal axis of the die pack 16. The ram longitudinal axis 36 is substantially aligned, meaning substantially on the same line, with the redraw die central axis 46. The redraw die circular opening 44 has a smaller diameter than the cup 2.

Figure 2:
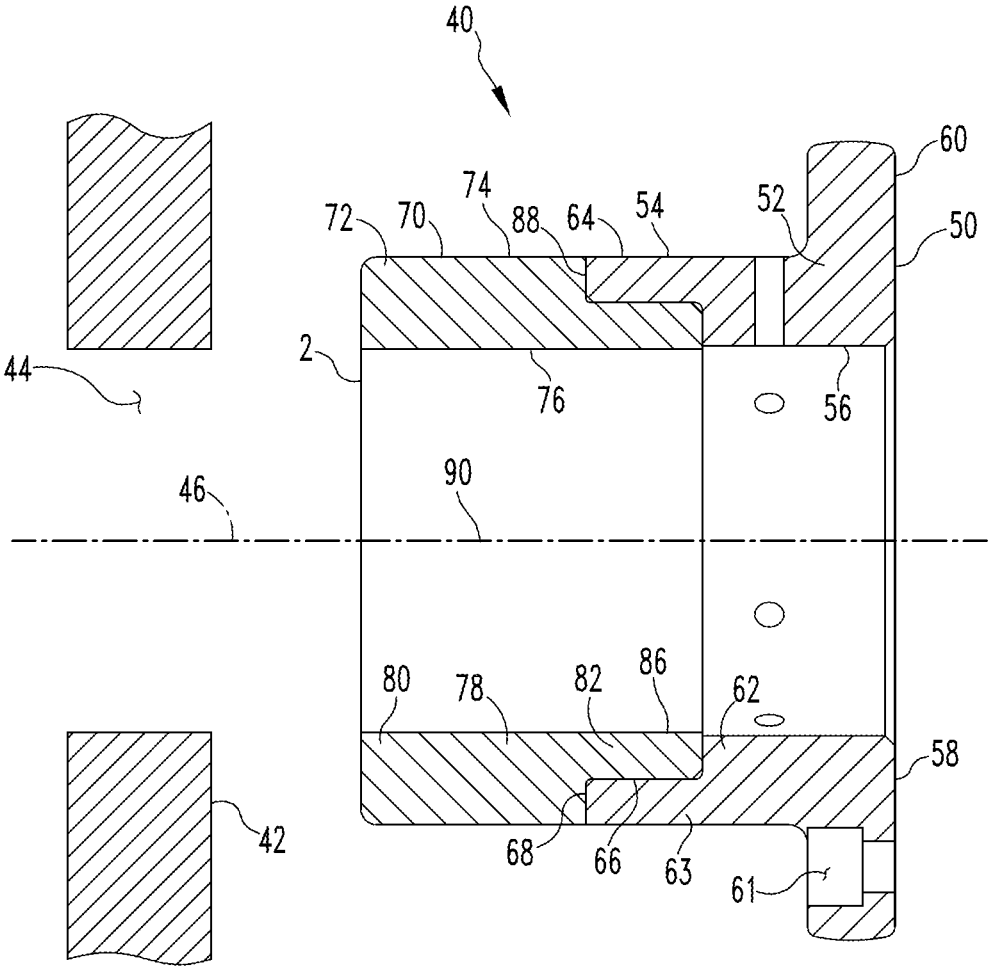
FIG. 2 is a cross-sectional side view of a redraw sleeve assembly.

As shown in FIG. 2, the redraw sleeve assembly 40 is structured to be, and is, coupled to the drive mechanism 14 and is structured to move between a first position, wherein the movable redraw sleeve assembly 40 is spaced from the redraw die 42, and a second position, wherein the movable redraw sleeve assembly 40 is disposed immediately adjacent the redraw die 42. In the second position, the redraw sleeve assembly 40 biases, i.e., clamps, the cup 2, and more specifically the cup bottom, against the redraw die 42. The cup 2 is further positioned so that the center of the cup 2 is disposed substantially on the redraw die central axis 46. As is known, the drive mechanism 14 is operatively coupled to the redraw sleeve assembly 40 via the drive mechanism 14 as shown in either U.S. Pat. Nos. 5,497,646 or 9,352,375. The redraw sleeve assembly 40 may also be moved by any known device and/or method.

In an exemplary embodiment, the redraw sleeve assembly 40 includes a mounting 50 and a redraw sleeve 70. The redraw assembly mounting 50 (hereinafter "mounting" 50) includes a generally torus shaped body 52. That is, in an exemplary embodiment, the mounting body 52 is a generally hollow cylinder having an outer radius, defining a generally circular outer surface 54, and an inner radius defining a generally circular inner surface 56. In an exemplary embodiment, the mounting body inner surface 56 has a radius that is larger than the radius of the ram 12 and/or the punch 38. Further, the mounting body 52 includes a first end 58 and a second end 62. In an exemplary embodiment, the mounting body 52 is a metal body.

The mounting body first end 58, in an exemplary embodiment, is disposed closer to the drive mechanism 14. Further, the mounting body first end 58 includes an outwardly extending flange 60. The mounting body first end flange 60, in an exemplary embodiment, includes a number of axial passages 61. As used herein, an "axial passage" is a passage that extends in a direction generally parallel to the redraw die central axis 46. Each mounting body first end flange passage 61 is sized and shaped to accommodate a coupling component (not shown). The mounting body 52 is structured to be, and is, movably coupled to the drive mechanism 14.

The mounting body second end 62 includes a collar 63. The mounting body second end collar 63 is also a generally torus shaped body having an outer radius, defining a generally circular outer surface 64, and an inner radius defining a generally circular inner surface 66. The mounting body second end collar outer surface 64 is sized to fit within a cup 2; that is, the mounting body second end collar outer surface 64 has a smaller radius than a cup 2. The mounting body second end collar outer surface 64, in an exemplary embodiment, has substantially the same radius as the mounting body outer surface 54. The mounting body second end collar inner surface 66 has a greater inner radius compared to the mounting body inner surface 56. Thus, generally, the mounting body second end collar 63 is a forwardly extending flange. Further, in an exemplary embodiment, the mounting body second end collar 63 includes a forward surface 68. The mounting body second end collar forward surface 68 is substantially planar, or, has a contour that substantially corresponds to the redraw sleeve body first end collar rearward surface 88 contour. In an exemplary embodiment, the mounting body second end collar 63 is unitary with the mounting body 52.

In an exemplary embodiment, the redraw sleeve 70 also includes a generally torus shaped body 72. The redraw sleeve body 72 is a generally hollow cylinder having an outer radius, defining a generally circular outer surface 74, and an inner radius defining a generally circular inner surface 76. In an exemplary embodiment, the mounting body inner surface 76 has a radius that is larger than the radius of the ram 12 and/or the punch 38, but is slightly smaller than the mounting body inner surface 56. Further, the redraw sleeve body 72 includes a first end 78 and a second end 80. In an exemplary embodiment, the redraw sleeve body 72 is one of a ceramic body or a carbide body.

The redraw sleeve body first end 78 includes a collar 82. The redraw sleeve body first end collar 82 is also a generally torus shaped body having an outer radius, defining a generally circular outer surface 84, and an inner radius defining a generally circular inner surface 86. The mounting body second end collar outer surface 84, in an exemplary embodiment, has a reduced radius relative to the redraw sleeve body outer surface 74. The redraw sleeve body first end collar inner surface 86 has substantially the same radius as the redraw sleeve body inner surface 76. Thus, generally, the mounting body second end collar 63 is a rearwardly extending flange. The redraw sleeve body first end collar 82 also includes a rearward surface 88. In an exemplary embodiment, the redraw sleeve body first end collar rearward surface 88 is substantially planar. In another exemplary embodiment, the redraw sleeve body first end collar rearward surface 88 includes a contour (not shown) such as, but not limited to a corrugated surface. In an exemplary embodiment, the redraw sleeve body first end collar 82 is unitary with the redraw sleeve body 72. In this configuration, the redraw sleeve body 72 defines a longitudinal axis 90. It is noted that, during operation of the can bodymaker 10, the redraw sleeve body longitudinal axis 90 is substantially aligned with the ram axis 36.

The "redraw sleeve body second end" 80 as used herein, means the portion of the redraw sleeve body 72 that is disposed within the cup 2 prior to the cup 2 entering the redraw die 42, i.e., the portion of the redraw sleeve body 72 that fits within a cup 2 before the cup is further formed in the die pack 16 and/or the redraw die 42. In an exemplary embodiment shown in FIG. 3, the redraw sleeve body second end 80 includes a forward axial surface 100, a transition surface 102, and a radial surface 104. As is known, and as used herein, the redraw sleeve body second end axial surface 100, hereinafter "second end axial surface" 100 is the surface that is generally planar and generally perpendicular to the redraw sleeve body axis 90. Further, as used herein, the transition surface 102 is the surface between the second end axial surface 100 and the redraw sleeve body second end radial surface 104 (hereinafter "second end radial surface" 104). The transition surface 102 is generally curvilinear and, in an exemplary embodiment, includes an arcuate surface having a radius and a center of curvature, or a multiple arcuate surface having multiple radii and multiple centers of curvature. Further, as used herein, the second end radial surface 104 is the surface that extends generally parallel to the redraw sleeve body axis 90.

The redraw sleeve body second end 80 has, in an exemplary embodiment, a "shaped contour." As used herein, a "shaped contour" on a redraw sleeve body second end 80 means the second end axial surface 100 and second end radial surface 104 are not substantially perpendicular and parallel, respectively, to the redraw sleeve body axis 90, or, wherein the second end axial surface 100 and second end radial surface 104 of the redraw sleeve body second end 80 include offset portions that are substantially perpendicular or parallel to the redraw sleeve body axis 90 but which are offset relative to a "perimeter contour," as defined below, of the redraw sleeve body second end 80. That is, the redraw sleeve body second end 80 includes a portion of the second end radial surface 104 disposed immediately adjacent the transition surface 102 which is, as used herein, the "radial perimeter" 110. Further, the perimeter portion of the second end axial surface 100 that extends toward the redraw sleeve body axis 90, from immediately adjacent the transition surface 102 is, as used herein, the "axial perimeter" 111. The contour defined by the radial perimeter and the axial perimeter is, as used herein, the "perimeter contour" of the redraw sleeve body second end 80.

Further, as used herein, a "tapered contour" on a redraw sleeve body second end 80 means the second end axial surface 100 and second end radial surface 104 are not substantially perpendicular and parallel, respectively, to the redraw sleeve body axis 90. That is, a "tapered contour" is a specific type of "shaped contour." Similarly, an "offset contour" on a redraw sleeve body second end 80 means the second end axial surface 100 and second end radial surface 104 include offset portions that are substantially perpendicular or parallel to the redraw sleeve body axis 90, respectively, but which are offset relative to the perimeter contour of the redraw sleeve body second end 80. That is, an "offset contour" is a specific type of "shaped contour." Further, an "offset contour" is, in an exemplary embodiment, a "minimally offset contour" wherein, as used herein, a "minimally offset contour" means that the offset portion is offset by a distance of between about 0.0005 inch and 0.001 inch.

Further, as used herein, a tapered contour is either an "inwardly" tapered contour, an "outwardly" tapered contour, or a "variably" tapered contour. As used herein, an "inwardly" tapered contour is a second end axial surface 100 that is tapered toward the redraw sleeve body first end 78 or a second end radial surface 104 that is tapered toward the redraw sleeve body axis 90. Conversely, as used herein, an "outwardly" tapered contour is a second end axial surface 100 that is tapered away from the redraw sleeve body first end 78 or a second end radial surface 104 that is tapered away from the redraw sleeve body axis 90. Thus, as used herein, a "variably" tapered contour is a second end axial surface 100 that includes both inwardly and outwardly tapered portions, or, a second end radial surface 104 that includes both inwardly and outwardly tapered portions. It is noted that the taper of the second end axial surface 100 and second end radial surface 104 is not substantial and that the second end axial surface 100 and second end radial surface 104 are still generally perpendicular and parallel, respectively, to the redraw sleeve body axis 90. That is, as used herein, a taper of between about zero (0) degrees and one (1) minute and zero degrees and ten (10) minutes (which is an inclusive range) is "not substantial." Further, a taper of less than zero (0) degrees and one (1) minute is, as used herein, "insubstantial" (which is less than "not substantial").

Similarly, as used herein, an offset contour is either an "inwardly" offset contour, an "outwardly" offset contour, or a "variably" offset contour. As used herein, an "inwardly" offset contour is a second end axial surface 100 that is offset toward the redraw sleeve body first end 78 or a second end radial surface 104 that is offset toward the redraw sleeve body axis 90. Conversely, as used herein, an "outwardly" offset contour is a second end axial surface 100 that is offset away from the redraw sleeve body first end 78 or a second end radial surface 104 that is offset away from the redraw sleeve body axis 90. Thus, as used herein, a "variably" offset contour is a second end axial surface 100 that includes both inwardly and outwardly offset portions, or, a second end radial surface 104 that includes both inwardly and outwardly offset portions.

The redraw sleeve body second end 80 has, in one exemplary embodiment, a tapered contour including an inwardly tapered contour, an outwardly tapered contour, a variably tapered contour, or a combination of such contours. In an alternative embodiment, the redraw sleeve body second end 80 has an offset contour including an inwardly offset contour, an outwardly offset contour, a variably offset contour, or a combination of such contours. In an alternative embodiment, the redraw sleeve body second end 80 has a combination of a tapered contour, including an inwardly tapered contour, an outwardly tapered contour, a variably tapered contour, or a combination of such contours, and, an offset contour including an inwardly offset contour, an outwardly offset contour, a variably offset contour, or a combination of such contours.

Figure 3:
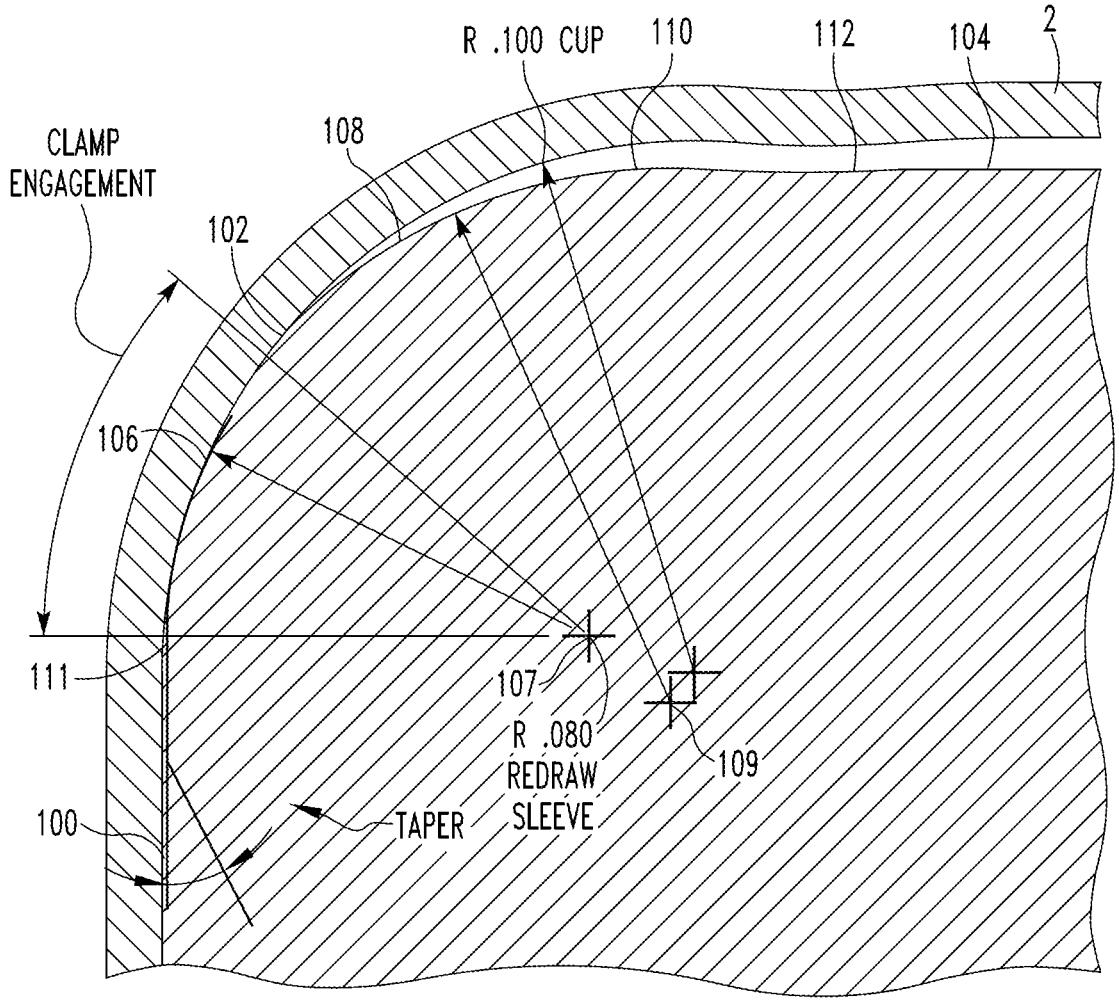
FIG. 3 is a detail cross-sectional side view of a redraw sleeve.

In an exemplary embodiment, the redraw sleeve body second end 80 includes an inwardly tapered second end axial surface 100 and an inwardly offset second end radial surface 104. That is, in this embodiment, the inwardly tapered second end axial surface 100 has a taper of between about 0°, 2' and 0°, 10' or about 0°, 5'. It is understood that, as used herein, the angle of the taper of the second end axial surface 100 is measured relative to a line perpendicular to the redraw sleeve body axis 90 and as measured on a cross-sectional surface of the second end axial surface 100 in a plane taken along the redraw sleeve body axis 90 (i.e., wherein the redraw sleeve body axis 90 lies entirely in the plane defining the cross-section), as shown in FIG. 3 (exaggerated). That is, the second end axial surface 100 is conical due to the taper and the cylindrical shape of the redraw sleeve body 72 in this exemplary embodiment. It is noted, however, that, as used herein, the second end axial surface 100 is still "generally planar" or "generally perpendicular" to the redraw sleeve body axis 90 because the angle of the taper is minimal.

Further, in this embodiment, the inwardly offset second end radial surface 104 includes a radial perimeter portion 110 and an offset portion 112. In an exemplary embodiment, the second end radial surface offset portion 112 is a minimally offset portion. That is, the second end radial surface offset portion 112 is inwardly offset relative to the second end radial surface radial perimeter portion 110 by a distance of between about 0.002 inch and 0.003 inch. In an exemplary embodiment, the second end radial surface offset portion 112 is inwardly offset relative to the second end radial surface radial perimeter portion 110 by a distance of about 0.0025 inch.

The configuration of the redraw sleeve body second end 80 as a "shaped contour" solves a number of the problems identified above.

It is noted that, as the second end axial surface 100 at the axial perimeter 111 and the second end radial surface 104 at the radial perimeter 110 are generally perpendicular to each other, the transition surface 102 curves about ninety degrees. Further, the transition surface 102 includes an engagement portion 106 and a number of other portions of the transition surface 102 that do not engage the cup 2. These portions are, hereinafter, identified as non-engagement portions 108. As used herein, an "engagement portion" 106 of a redraw sleeve body second end 80 is that portion of the transition surface 102 that initially engages the cup 2.

In an exemplary embodiment, the transition surface 102 is a "multi-radius" surface. As used herein, a "multi-radius" surface is a generally curvilinear surface defined by a plurality (more than one) arcuate portions wherein each arcuate portion is defined by an arc having a different center and/or radius when viewed in cross-section of the redraw sleeve body second end 80 in a plane taken along the redraw sleeve body axis 90, as shown in FIG. 3.

In an exemplary embodiment, the transition surface 102 is defined by two arcuate portions wherein one arcuate portion defines the engagement portion 106 and another arcuate portion defines a non-engagement portion 108. For example, one aluminum cup that is formed into a 12 oz. can body has a 3.937 inch inner diameter and a height of 1.315 inch as well as an internal corner radius of 0.100 inch. For such a cup, the redraw sleeve body second end 80 is configured as follows. The engagement portion 106 extends over an arc of about 41° and the transition surface 102 has a radius of between about 0.060 inch and 0.100 inch, or about 0.080 inch. In this embodiment, the non-engagement portion 108 extends over an arc of about 49° and wherein the transition surface 102 has a radius of between about 0.080 inch and 0.120 inch, or about 0.100 inch. Stated alternately, the transition surface corresponds to the cup radius. The transition surface 102 radius is, as used herein, the "relief radius." That is, the radius of the non-engagement portion 108 to the second end radial surface offset portion 112 is the "relief radius." Further, the engagement portion 106 has a radial center 107 (hereinafter "center") and the non-engagement portion 108 has a different center 109. The engagement portion center 107 and the non-engagement portion center 109 are separated by a "minimal separation distance" by a "specific minimal separation distance" As used herein, a "minimal separation distance" means between about 0.001 inch and 0.050 inch. As used herein, a "specific minimal separation distance" means about 0.015 inch. In this configuration the transition between the engagement portion 106 and the non-engagement portion 108 is generally smooth. In this configuration, the second end radial surface offset portion 112 is inwardly offset from the radial perimeter 110, which is the maximum radius of the redraw sleeve body 72, by between about 0.002 inch and 0.003 inch, or about 0.0025 inch. In this embodiment, the inwardly tapered second end axial surface 100 has a taper of between about 0°, 2' and 0°, 10' or about 0°, 5'.

Further, in this configuration, and when the bodymaker 10 is in use, the inner surface of the cup 2 extends generally tangent and congruent to the engagement portion 106 when the redraw sleeve body second end 80 initially engages the cup 2. As used herein, "initially engages the cup" means when the redraw sleeve body second end 80 contacts the cup 2 but before the cup 2 is moved into the redraw die 42. Stated alternately, the sleeve body second end 80, or the transition surface 102 contour, is structured to correspond to the cup 2. That is, a transition surface 102 contour that substantially corresponds to the inner surface of a cup 2 at the time when the sleeve body second end 80 initially engages the cup 2 is, as used herein, a "tangent and congruent" contour. Thus, in an exemplary embodiment, the transition surface 102, or the engagement portion 106, has a "tangent and congruent" contour.

In another exemplary embodiment, the transition surface 102 is again defined by two arcuate portions wherein one arcuate portion defines the engagement portion 106 and another arcuate portion defines a non-engagement portion 108. In this example, the aluminum cup that is formed into a 16 oz. can body has a 3.375 inch inner diameter and a height of 2.795 inch as well as an internal corner radius of 0.160 inch. For such a cup, the redraw sleeve body second end 80 is configured as follows. The engagement portion 106 extends over an arc of about 40° and wherein the transition surface 102 has a radius of between about 0.100 inch and 0.140 inch, or about 0.0120 inch. In this embodiment, the non-engagement portion 108 extends over an arc of about 50° and wherein the transition surface 102 has a radius of between about 0.140 inch and 0.180 inch, or about 0.160 inch. Stated alternately, the transition surface corresponds to the cup radius. The transition surface 102 radius is, as before and as used herein, the "relief radius." That is, the radius of the non-engagement portion 108 to the second end radial surface offset portion 112 is the "relief radius." In this configuration the transition between the engagement portion 106 and the non-engagement portion 108 is generally smooth. In this configuration, the second end radial surface offset portion 112 is inwardly offset from the radial perimeter 110, which is the maximum radius of the redraw sleeve body 72, by between about 0.002 inch and 0.003 inch, or about 0.0025 inch. In this embodiment, the inwardly tapered second end axial surface 100 has a taper of between about 0°, 5' and 0°, 10' or about 0°, 8'.

The configurations of the shaped contour as described above solves a number of the problems identified above.

Accordingly, the redraw assembly 40 includes, and as shown the redraw sleeve 70 is, a hollow circular tube with an outer diameter sized to fit within the cup 2 enclosed space. The redraw assembly 40 inner diameter is sized to allow the ram body 30 to pass therethrough. That is, the radius of the ram body 30, and more specifically the punch 38, is smaller than the redraw assembly 40 inner diameter by a distance substantially equal to the thickness of the material forming the cup 2. Thus, as the ram body 30, and more specifically the punch 38, forces the cup 2 through the redraw sleeve assembly 40, the cup 2 is elongated and resized to have a smaller diameter; the cup 2 wall thickness, however, remains substantially unchanged. The cup 2 is further formed into a can body by the die pack 16, as is known.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A redraw sleeve for a redraw assembly in a can bodymaker, said bodymaker including a die pack, said die pack including a redraw die, said die pack and said redraw die including a longitudinal axis, said redraw sleeve comprising:

a body including a second end;

said body second end includes an axial surface; and wherein said second end axial surface is an inwardly tapered second end axial surface.

2. The redraw sleeve of claim 1 wherein:

said second end includes a radial surface;

wherein said second end radial surface is an inwardly offset second end radial surface.

3. The redraw sleeve of claim 2 wherein said second end axial surface has a taper of between about 0°, 2' and 0°, 10'.

4. The redraw sleeve of claim 2 wherein:

said second end radial surface includes a radial perimeter portion and an offset portion; and wherein said second end offset portion is inwardly offset relative to the second end radial surface radial perimeter portion by a distance of between about 0.0005 inch and 0.001 inch.

5. A bodymaker comprising:

a ram;

a drive mechanism coupled to the ram and structured to impart a reciprocating motion to said ram;

a die pack;

said ram structured to reciprocate between a first, retracted position, wherein said ram is spaced from said die pack, and a second, extended position, wherein said ram extends through the die pack;

a redraw assembly including a movable redraw sleeve assembly and a redraw die;

said redraw die disposed within said die pack;

said redraw assembly including a redraw sleeve;

said redraw sleeve including a body with a second end;

said body second end includes an axial surface; and wherein said second end axial surface is an inwardly tapered second end axial surface.

6. The bodymaker of claim 5 wherein:

said second end includes a radial surface;

wherein said second end radial surface is an inwardly offset second end radial surface.

7. The bodymaker of claim 6 wherein said second end axial surface has a taper of between about 0°, 2' and 0°, 10'.

8. The bodymaker of claim 6 wherein:

said second end radial surface includes a radial perimeter portion and an offset portion; and wherein said second end offset portion is inwardly offset relative to the second end radial surface radial perimeter portion by a distance of between about 0.0005 inch and 0.001 inch.

* * * * *